United States Patent [19]

Borgen

[11] 4,144,981

[45] Mar. 20, 1979

[54] PORTABLE LADLE FOR USE WITH A FORKLIFT TRUCK

[75] Inventor: Arden L. Borgen, Webster City, Iowa

[73] Assignee: Arrow-Acme Corporation, Webster City, Iowa

[21] Appl. No.: 800,212

[22] Filed: May 25, 1977

[51] Int. Cl.[2] ..... B22D 41/06; B22D 41/12

[52] U.S. Cl. ..... 414/607; 222/610; 414/420

[58] Field of Search ..... 214/620–624, 214/302, 313–315, 701 Q, 768, 701 R, 701 P; 222/604, 610; 212/130

[56] References Cited

U.S. PATENT DOCUMENTS

| | | | |
|---|---|---|---|
| 2,664,276 | 12/1953 | Wagner et al. | 214/621 |
| 3,039,631 | 6/1962 | Baker | 214/313 |
| 3,318,473 | 5/1967 | Jones et al. | 214/620 |
| 3,971,485 | 7/1976 | Hoppey | 214/620 |

FOREIGN PATENT DOCUMENTS

| | | | |
|---|---|---|---|
| 66848 | 5/1969 | German Democratic Rep. | 214/620 |

*Primary Examiner*—Francis S. Husar
*Assistant Examiner*—R. B. Johnson
*Attorney, Agent, or Firm*—James E. Nilles

[57] ABSTRACT

A portable transfer ladle for receiving molten metal from a melting furnace and depositing it in holding furnaces or molds remote from the melting furnace is constructed so as to be transportable by and operable while on a conventional forklift truck. The portable transfer ladle includes a support structure having hollow elongated spaced apart members for engagement with the tines of the forklift truck, a cylindrical ladle rotatably mounted on the support structure, and a ladle drive assembly mounted on the support structure to rotate the ladle and including a motor detachably connectable for energization and control from a power source located on the forklift truck.

9 Claims, 6 Drawing Figures

PORTABLE LADLE FOR USE WITH A FORKLIFT TRUCK

BACKGROUND OF THE INVENTION

1. Field of Use

This invention relates to portable transfer ladles for receiving molten metal from a furnace and for depositing it in holding furnaces or molds remote from the furnace. In particular, it relates to a portable transfer ladle which can be transported by and operated while on a conventional forklift truck by detachably connectable power supply means and control means on the forklift truck.

2. Description of the Prior Art

Portable transfer ladles for transferring molten metal from a furnace to remotely located holding furnaces or molds are known. In some prior art arrangements, the transfer ladle is movable along a trolley which is permanently installed in a manufacturing plant and the path of movement of the transfer ladle is necessarily limited. In some such arrangements, a cylindrical ladle rotatable about its longitudinal axis is used, but manual means are employed to rotate or tilt the cylinder during a pouring operation. In other prior art arrangements, various kinds of ladles are transported by forklift trucks, but either are permanently mounted thereon or the forklift truck needs to be specially modified so as to be able to handle, transport, and operate the transfer ladle. The latter arrangements, while improving over the aforedescribed trolley arrangement, are expensive and limit other usage of the forklift truck. U.S. Pat. No. 3,003,206 shows a forklift truck for transporting a ladle assembly and having control levers on the lift trucks connectable by flexible lines to operate the ladle. U.S. Pat. No. 2,756,888 shows a forklift truck specially adapted to carry and effect movement of an object such as a barrel and U.S. Pat. No. 3,788,492 shows a similar arrangement.

SUMMARY OF THE PRESENT INVENTION

In accordance with the present invention, there is provided a portable transfer ladle for receiving molten metal from a furnace and depositing it in molds remote from the furnace. The portable transfer ladle is designed and constructed so that it can be connected to, raised, lowered, transported, disengaged from, and operated while on a conventional forklift truck having a fork assembly including spaced apart tines which can be raised and lowered. The portable transfer ladle includes a support structure having hollow elongated spaced apart members for engagement with the tines of the forklift truck, a cylindrical ladle rotatably mounted on the support structure, and a ladle drive assembly mounted on the support structure for rotating the cylindrical ladle and including a motor detachably connectable for energization and control by means of a power source and control means located on the forklift truck. The support structure includes ladle support plates which are rigidly connected to and extend upwardly from the hollow elongated spaced apart members and carry bearings in which the trunnions of the cylindrical ladle are journalled. The longitudinal axis of rotation of the cylindrical ladle is parallel to, above, and located between the hollow elongated spaced apart members. The ladle drive assembly includes an electric motor, a gear reduction unit driven thereby, and a rotation chain driven by the gear reduction unit and connected to the cylindrical ladle to effect rotation thereof. The power supply source and control means comprise the lift truck electrical system or a separate battery and control element located on the forklift truck and connectable to the electric motor by a flexible cable.

The portable transfer ladle is designed to have maximum stability when resting on the floor or when being transported by or operated on the forklift truck. Furthermore, the cylindrical ladle is constructed, mounted, and balanced on the support structure so as to be easily tilted or rotated about its longitudinal axis between pouring and non-pouring positions with a minimum amount of energy and with a maximum amount of control. A portable transfer ladle in accordance with the invention is readily useable with conventional forklift trucks without requiring any modification of the latter and its power supply and control means can be easily and quickly connected and disconnected from a power source on the forklift truck. A portable transfer ladle in accordance with the present invention employs conventional commercially available components which are easily and economically assembled and reliable in use. A portable transfer ladle in accordance with the invention is well-balanced, stable, and safe in use and requires a minimum of energy input for operation. Other objects and advantages of the invention will hereinafter appear.

DESCRIPTION OF THE PREFERRED EMBODIMENT

Figure 2:
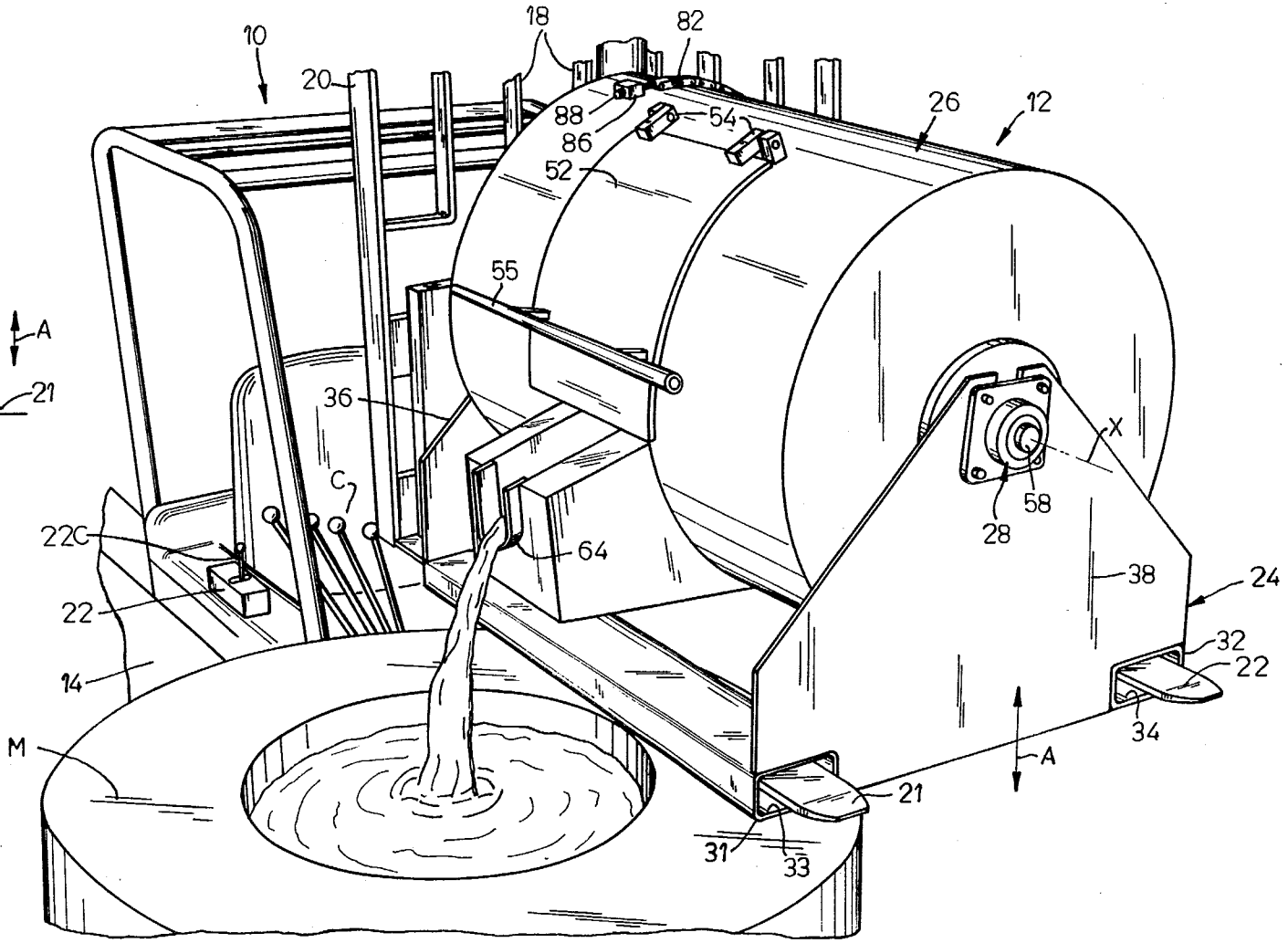
FIG. 2 is an enlarged perspective view of the portable transfer ladle shown supported in elevated position by the forklift truck and showing its cylindrical ladle tilted to the pouring position.
Figure 1:
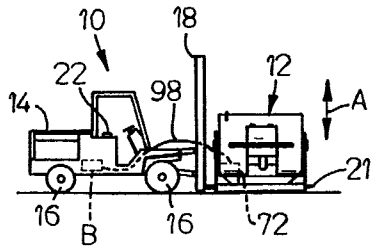
FIG. 1 is a side elevational view of a forklift truck connected to and supporting a portable transfer ladle in accordance with the invention.
Figure 5:
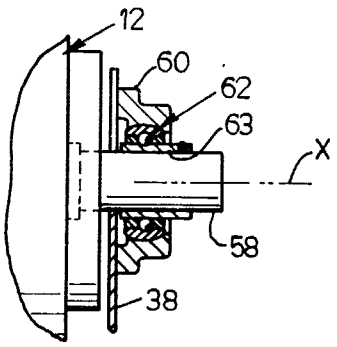
FIG. 5 is an enlarged view partly in cross section of a trunnion and trunnion bearing at one end of the portable transfer ladle and taken on line 5—5 of FIG. 4.
Figure 4:
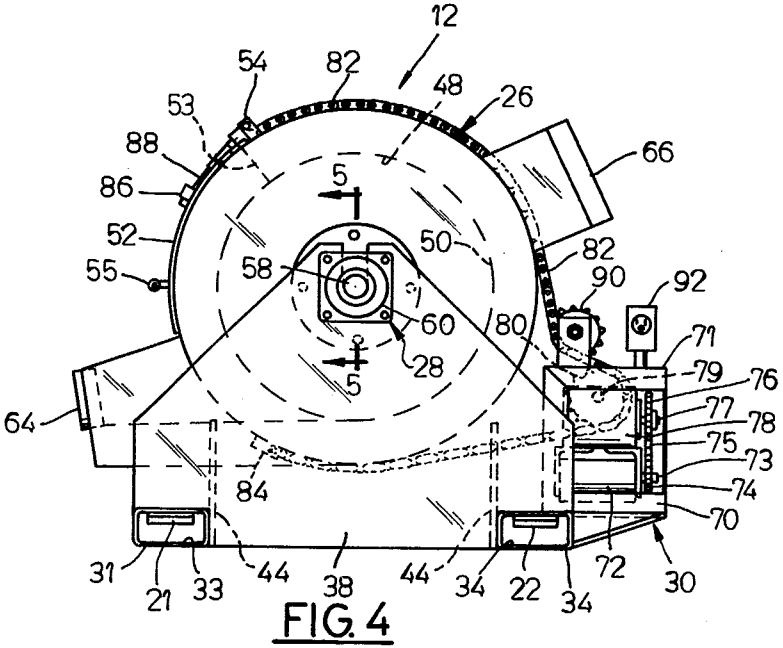
FIG. 4 is an end elevational view of the portable transfer ladle.

Referring to FIG. 1, there is shown a forklift truck 10 upon which a portable transfer ladle 12 in accordance with the invention is supported for transport. Forklift truck 10 comprises a chassis 14, ground-engaging wheels 16, a generally upwardly extending carriage support 18 at the front end of the forklift truck, and a carriage 20 which is mounted in a conventional manner on the carriage support and adapted to be raised and lowered in the direction of Arrow A by suitable motive and control means (not shown) on the forklift truck. Carriage 20 is shown in FIGS. 2 and 4 as comprising a pair of spaced apart tines 21 and 22 which project forwardly from the forklift truck 10. It is to be understood that forklift truck 10 is conventional and may be driven by an internal combustion engine (not shown) or by an electric motor (not shown). Forklift truck 10 is provided with a power source such as a battery B which serves as a power supply source for electrically operated components on the forklift truck 10 and may, for example, be a 12 or 24 volt battery. Forklift truck 10 is also provided with operator's controls generally designated designated C for carrying out necessary control functions on the forklift truck. Forklift truck 10 is also provided with a control element 22 for controlling operation of the portable transfer ladle 12 as hereinafter described.

Figure 3:
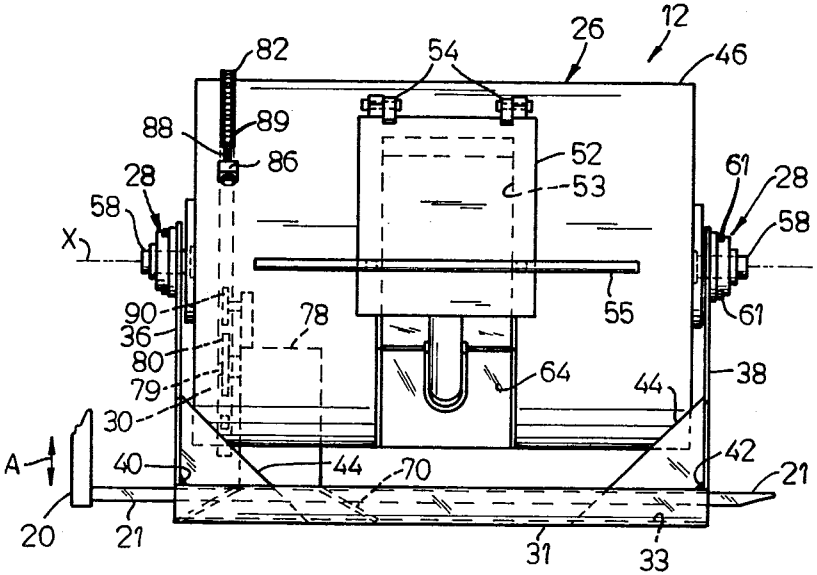
FIG. 3 is a side elevational view of the portable transfer ladle shown in FIGS. 1 and 2.

As FIGS. 2, 3, and 4 best show, the portable transfer ladle 12 generally comprises a support structure 24, a cylindrical ladle 26, bearing means 28 for rotatably supporting the cylindrical ladle on the support structure, and a ladle drive assembly 30 which is mounted on the support structure and effects rotation of the cylindrical ladle. As FIGS. 1 and 2 make clear, portable transfer ladle 12 is adapted to rest on the ground and can be filled with molten metal or operated to pour molten metal from such a position. Furthermore, the portable transfer ladle 12 is adapted to be engaged by, raised and lowered, or transported by means of forklift truck 10 and as FIG. 2 shows, the cylindrical ladle 26 thereof may be filled with or emptied of molten metal while supported by the forklift truck, as FIG. 2 makes clear.

The support structure 24 comprises means for releasable engagement with the tines 21 and 22 of the forklift truck 10. Such means take the form of a pair of spaced apart box beams 31 and 32 which are fabricated of heavy gauge steel and have openings 33 and 34, respectively, extending therethrough for receiving the tines 21 and 22, respectively. Support structure 24 further comprises a pair of ladle support plates or members 36 and 38 which, like the beams 31 and 32, are fabricated of heavy gauge steel. The support plates 36 and 38, which are preferably generally triangular in shape so as to reduce weight and afford clearance and accessibility, are rigidly secured as by welding at 40 and 42, respectively, at or near opposite ends of the box beams 31 and 32. Four gussets, each designated 44, are each welded between a ladle support plate 36, 38 and an end of a box beam 31, 32. Thus, support structure 24 is extremely strong and rigid and capable of supporting cylindrical ladle 26 thereon.

The cylindrical ladle 26, which is understood to be rotatable about its longitudinal axis X (see FIG. 3) between a non-pouring position (not shown) and a pouring position, shown in FIGS. 2, 3, and 4, comprises a reinforced steel cylindrical container 46 which has a refractory lining 48 on the inner surface thereof and defines a space or chamber 50 for receiving molten metal. Cylindrical ladle 26 comprises a lid or cover 52, shown in closed position, which is connected to the steel bowl 46 by lid hinges 54 and is provided with a handle 55 by means of which the lid can be opened when filling the cylindrical ladle 26. Cylindrical ladle 26 is provided with trunnions or pivot shafts 58 which extend outwardly from the opposite ends thereof along the axis X. Cylindrical ladle 26 is supported on the ladle support plates 36 and 38 by the bearing means 28 which engage the trunnions 58. As FIGS. 2–5 best show, each bearing means 28 comprises a generally rectangular flange unit 60 which is secured by means of bolts 61 to a ladle support plate 36, 38. Flange unit 60 supports an anti-friction ball bearing assembly 62 therein and a trunnion 58 of the cylindrical ladle 26 is journalled into an opening 63 in ball bearing assembly 62. Cylindrical ladle 26 further comprises a pouring lip or spout 64 on the side thereof which serves as a means for directing the flow of molten metal into a holding furnace or mold M as FIG. 2 shows. Cylindrical ladle 26 is also provided with a counterweight 66 which is located on the periphery thereof in a position substantially opposite to that of the pouring spout 64. The purpose of the counterweight is to counter balance the weight of the pouring spout, of any metal being poured therefrom, and make rotation of the cylindrical ladle 26 about its axis X easier to effect and for safety.

The ladle drive assembly 30 is mounted on the support structure 24 and is adapted to effect limited rotation of the cylindrical ladle 26 about axis X between non-pouring and pouring positions. As FIGS. 3 and 4 best show, ladle drive assembly 30 comprises a mounting bracket 70 which is rigidly secured to support structure 24 and made up of suitably sized angular steel members 71. The drive assembly 30 is preferably located as low as possible on the support structure 24 to lower the center of gravity of the portable transfer ladle 12 and thereby assist in stabilization thereof when being transported. Ladle drive assembly 30 comprises a DC electric motor 72 which is mounted on bracket 70 and has a drive shaft 73 which is connected to drive a drive sprocket 74. Drive sprocket 74 is connected by means of an endless drive chain 75 to a driven sprocket 76 which is connected to an input shaft 77 of a gear reduction unit 78 which is mounted on the bracket 70 and is part of the ladle drive assembly 30. Gear reduction unit 78 has an output shaft 79 on which a drive sprocket and torque limiter 80 are mounted. Drive sprocket 80 engages a flexible rotation chain 82 which has one end connected to a first chain fastener 84 on the exterior of cylindrical ladle 26 and has its other end connected to a second chain fastener 86 at another point on the periphery of cylindrical ladle 26. As FIG. 4 shows, a chain tightening device 88 is secured between chain end fastener 86 and a connection point 89 on the cylindrical ladle 26. The mounting bracket 70 of the ladle drive assembly 30 is also provided with an idler sprocket 90 which engages the rotation chain 82 as FIG. 4 shows. In operation, rotation of electric motor 72 in one direction ultimately causes rotation chain 82 to be driven and causes rotation of cylindrical ladle 26 about its axis X in a corresponding direction. If motor 72 is driven in the opposite direction, of course, cylindrical ladle 26 is correspondlingly driven in the opposite direction.

Figure 6:
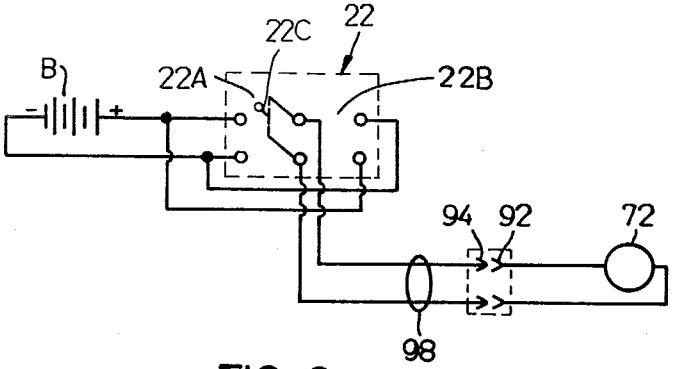
FIG. 6 is an elementary electric circuit diagram of the power supply, control switches, power plug and receptacle, and electric motor for the drive assembly of the portable transfer ladle.

As FIGS. 1 and 6 show, DC electric motor 72 is detachably connected by means of a DC power input receptacle 92 and a DC power plug 94 through the control element 22 to battery B. It is to be understood that in the embodiment disclosed, cylindrical ladle 26 of portable transfer ladle 12 is rotated by means of an electric motor 72 energized from a power supply source on forklift truck 10 which takes the form of a battery B and the control element 22 takes the form of an electric switch hereinafter described. However, a pneumatic or hydraulic motor could be employed instead of an electric motor and could be energized from a suitable power supply source other than battery B located on forklift truck 10 by means of a suitable control element other than a switch. In the embodiment shown in FIG. 6, the control element 22 comprises a control lever 22C and forward contacts 22A and reverse contacts 22B. Control element 22 is a double pole, double throw normally open electric switch which can be closed for a desired interval of time by the machine operator to effect energization of electric motor 72 for the interval of time necessary to effect the desired amount of rotation of cylindrical ladle 26. Control lever 22C, which is understood to be biased to neutral or open position, is preferably mounted on truck 10 so that the left and right throw thereof effects left or right rotation, respectively, of the ladle 26. Since battery B is a DC source and motor 72 is a DC motor, it is necessary to effect reversal of the connections therebetween to effect reversal of the direction of rotation of motor 72 and thus the direction of rotation of cylindrical ladle 26. Any suitable electric circuit and switching arrangement for accomplishing this purpose may be employed. As FIG. 6 makes clear, battery B and control element 22 are located on forklift truck 10 and motor 72 is located on the portable transfer ladle 12. Furthermore, the DC power input receptacle 92 is located on the portable transfer ladle 12, as FIG. 4 shows, on the bracket 70. The DC power plug 94, however, is attached to the end of a flexible cable 98 which is carried on forklift truck 10, for example.

OPERATION

The aforedescribed apparatus operates as follows. Assuming that portable transfer ladle 12 is resting on a floor, the forklift truck 10 is maneuvered into an appropriate position and its tines 21, 22 are lowered and positioned so as to be extendable into the openings 33 and 34, respectively, of the box beams 31 and 32, respectively, whereupon the forklift truck is advanced so that the tines fully engage the portable transfer ladle 12. The connection is then made between the power supply and the ladle. After this is done, the forklift carriage 20 is raised to the desired height, thereby raising the portable transfer ladle 12, and the latter may be transported to desired locations. If cylindrical ladle 26 of portable transfer ladle 12 has not already been filled with molten metal, it is moved to a molten metal source, rotated into a position wherein its fill opening 53 is in an upper position, lid 52 is opened and the ladle is filled, whereupon the lid 52 is closed. After forklift truck 10 has moved the filled portable transfer ladle to a desired location and molten metal is ready to be poured therefrom, the operator actuates the appropriate switch of control element 22 to rotate the cylindrical ladle 26 about its axis X to the degree necessary to cause molten metal to pour from spout 64. When pouring is completed, cylindrical ladle 26 is rotated in a reverse direction to stop pouring.

As is apparent from the foregoing description, portable transfer ladle 12 is constructed so that it can be handled by any conventional forklift truck 10 which has forwardly projecting tines such as 21 and 22 and is of suitable carrying capacity. No modification to the forklift truck 10 needs to be made provided the spacing of the tines 21, 22 is sufficient to accommodate the distance or spacing between the box beams 31 and 32 of the portable transfer ladle 12. As will be noted, the rotation axis X of cylindrical ladle 26 is parallel to, above, and intermediately located with respect to the box beams 31 and 32 thereby resulting in a very stable structure. Also, the ladle drive assembly 30 is located as low as possible on the support structure 24 to afford further stability. As hereinbefore explained, the counterweight 66 on cylindrical ladle 26 stabilizes the ladle during the rotation and minimizes the amount of power required to effect rotation. Thus, the ladle drive assembly 30 is able to employ a DC electric motor 72 which can be operated from the conventional storage battery B used on most forklift trucks. The gear reduction unit 78 in the ladle drive assembly 30 and the manner in which it is connected between motor 72 and cylindrical ladle 26 results in good control and also reduces power requirements for rotating the ladle 26.

It should also be noted that the counterweight 66 is positioned on cylindrical ladle 26 and is of such weight with respect to the weight of the ladle 26 and the pouring spout 64 and the contents of the ladle 26 that if rotation chain 82 breaks, the cylindrical ladle 26 tends to rotate to a safety position wherein the counterweight 66 points substantially downward vertically and the pouring spout 64, as well as the fill opening point upwardly, thereby preventing molten metal from accidentally being spilled.

In the embodiment shown, one pouring spout 64 and counterweight 66 are shown. However, two pouring spouts such as 64 could be located on opposite sides of ladle 26 and two counterweights such as 66 could be provided therefor, each counterweight being located on the side of ladle 26 opposite to the spout it counterbalances.

I claim:

1. A portable transfer ladle for use with a forklift truck having spaced apart tines and a power supply source thereon comprising:

a support structure having a pair of spaced apart tine-receiving holes therein and including a pair of spaced apart ladle support members located above said holes and bearing means on said pair of ladle support members for rotatably supporting a cylindrical ladle;

a cylindrical ladle rotatably mounted on said spaced apart ladle support members of said support structure and rotatable about the longitudinal axis of said cylindrical ladle which is located above and between said spaced apart tine-receiving holes, said cylindrical ladle having a spout on one side and a counter-weight located on the periphery thereof in a position substantially opposite to said spout, said support members mounting said bearing means along the longitudinal axis of said ladle;

and a ladle drive assembly mounted on said support structure and connected to rotate said cylindrical ladle, said ladle drive assembly including a motor detachably connectable for energization and control from said power supply source.

2. A portable transfer ladle according to claim 1 wherein said support structure comprises a pair of hollow elongated spaced apart members each having one of said tine-receiving holes therein and on which said pair of ladle support members are mounted.

3. A portable transfer ladle according to claim 2 wherein said tine-receiving holes extend parallel to said axis.

4. A portable transfer ladle according to claim 1 wherein said ladle drive assembly further includes a reduction gear unit driven by said motor, a drive sprocket on said reduction gear unit, and a cylinder drive chain engaged with said sprocket and having its ends connected to said cylindrical ladle.

5. A portable transfer ladle according to claim 4 wherein said ladle drive assembly includes a power input receptacle.

6. A portable transfer ladle for molten metal for use with a forklift truck having spaced apart tines and a power supply source thereon comprising:

a support structure comprising a pair of hollow enlongated spaced apart members each having a tine-receiving hole therein, said support structure further including a pair of spaced apart ladle support members, each ladle support member being rigidly connected to said hollow elongated members;

a cylindrical ladle rotatably mounted on said support structure, said cylindrical ladle being rotatable about an axis which is located above and between said spaced apart members, said cylindrical ladle having a spout on one side and a counterweight located on the periphery thereof in a position substantially opposite to said spout, means on the inner surface of said ladle that defines a chamber for receiving molten metal;

bearing means on said pair of ladle support members for rotatably supporting said cylindrical ladle;

and a ladle drive assembly mounted on said support structure and connected to rotate said cylindrical ladle, said ladle drive assembly including a motor detachably connectable for energization and control from said power supply source.

7. A portable transfer ladle according to claim 6 wherein the tine-receiving holes in said hollow elongated spaced apart members extend parallel to said axis.

8. A portable transfer ladle according to claim 6 wherein said ladle drive assembly further includes a reduction gear unit driven by said motor, a drive sprocket on said reduction gear unit, and a cylindrical drive chain engaged with said sprocket and having its ends connected to said cylindrical ladle.

9. A portable transfer ladle according to claim 8 wherein said motor is an electric motor and wherein a power input receptacle is mounted on said support structure.

* * * * *